US006595653B2

(12) United States Patent
Saito et al.

(10) Patent No.: US 6,595,653 B2
(45) Date of Patent: Jul. 22, 2003

(54) LIGHT ILLUMINATING TYPE SWITCH

(75) Inventors: Atsushi Saito, Tokyo (JP); Yasufumi Naoi, Narashino (JP)

(73) Assignee: Seiko Precision Inc. (JP)

( * ) Notice: Subject to any disclaimer, the term of this patent is extended or adjusted under 35 U.S.C. 154(b) by 0 days.

(21) Appl. No.: 09/923,651

(22) Filed: Aug. 6, 2001

(65) Prior Publication Data

US 2002/0030987 A1 Mar. 14, 2002

(30) Foreign Application Priority Data

Aug. 8, 2000 (JP) ..... 2000/239948

(51) Int. Cl.[7] ..... F21V 9/16

(52) U.S. Cl. ..... 362/84; 362/23; 362/29; 200/314; 200/317; 200/513

(58) Field of Search ..... 362/84, 23, 29; 200/314, 315, 317, 512–517; 313/506

(56) References Cited

U.S. PATENT DOCUMENTS 5,871,088 A * 2/1999 Tanabe ..... 200/314
5,924,555 A * 7/1999 Sadamori et al. ..... 200/238
6,246,169 B1 * 6/2001 Pruvot ..... 200/314

FOREIGN PATENT DOCUMENTS

JP P2000-64023 3/2000

* cited by examiner

*Primary Examiner*—Sandra O'Shea
*Assistant Examiner*—Guiyoung Lee
(74) *Attorney, Agent, or Firm*—Joel E. Lutzker; Donna L. Angotti; Schulte Both & Zabel LLP

(57) ABSTRACT

A light illuminating type switch with a good click rate and having a desired click characteristic near to that of a single member of a metal dome. Fixed contacts 7*a* are provided on a base sheet 7. On an upper side of the base sheet 7, a dome shaped movable contact 8 capable of electrically connecting the fixed contacts 7*a* on the base sheet by being elastically deformed is arranged. The surface of the dome shaped movable contact 8 is attached with a flexible EL sheet E by using adhering agents 9*a* and 9*b* via an insulating member 6 over a peripheral portion of the dome shaped movable contact 8. The EL sheet E is formed with cut portions 10 partially at positions along an outer peripheral edge of the dome shaped movable contact 8. At least a pair of the cut portions 10 are formed at symmetrical positions centering on the movable contact 8.

4 Claims, 3 Drawing Sheets

LIGHT ILLUMINATING TYPE SWITCH

TECHNICAL FIELD TO WHICH THE INVENTION BELONGS

The present invention relates to a light illuminating type switch utilized in a portable information apparatus.

BACKGROUND OF THE INVENTION

A prior light illuminating type switch, for example, Japanese Patent Application No. 67095/1999 previously proposed by the applicant, as shown by FIG. 5 and FIG. 6, is a structure where fixed contacts A are on an upper side of a base sheet B. An upper side of a dome shaped movable contact C is attached with a flexible electro-luminescent (EL) sheet E by an adhering agent F while interposing an insulating member D.

SUMMARY OF THE INVENTION

According to the prior light illuminating type switch, a characteristic of switch operation feeling in operating to depress and release a switch, called the click characteristic, is inferior to the click characteristic for the case of a single member of a metal dome which is not attached with the insulating member D and the EL sheet E. That is, where a click rate of the single member of a metal dome achieved 49%. The prior structure attached with the EL sheet has a click rate of 43%.

According to the invention, there is provided a light illuminating type switch that has a click rate and a click characteristic near to that of the single member of the metal dome, i.e. 49%.

According to an aspect of the invention, a light illuminating type switch has a base sheet with a fixed contact, wherein an upper side of the base sheet is arranged with a dome shaped movable contact brought into contact with and separated from the fixed contact in moderation by being elastically deformed. A surface of the movable contact is attached with a flexible EL sheet extended along the surface over to a peripheral portion of the movable contact via an insulating member. The EL sheet is partially formed with at least one cut portion at a position along an outer peripheral edge of the dome shaped movable contact. The cut portions promote the click characteristics.

It is preferable that at least one pair of cut portions are formed at symmetrical positions centering on the movable contact. Further, it is preferable that the movable contact and the insulating member are attached to each other by an adhering agent or an adhesive double-coated sheet.

DESCRIPTION OF THE PREFERRED EMBODIMENTS

An explanation will be given of an embodiment of the invention with reference to the drawings.

Figure 1:
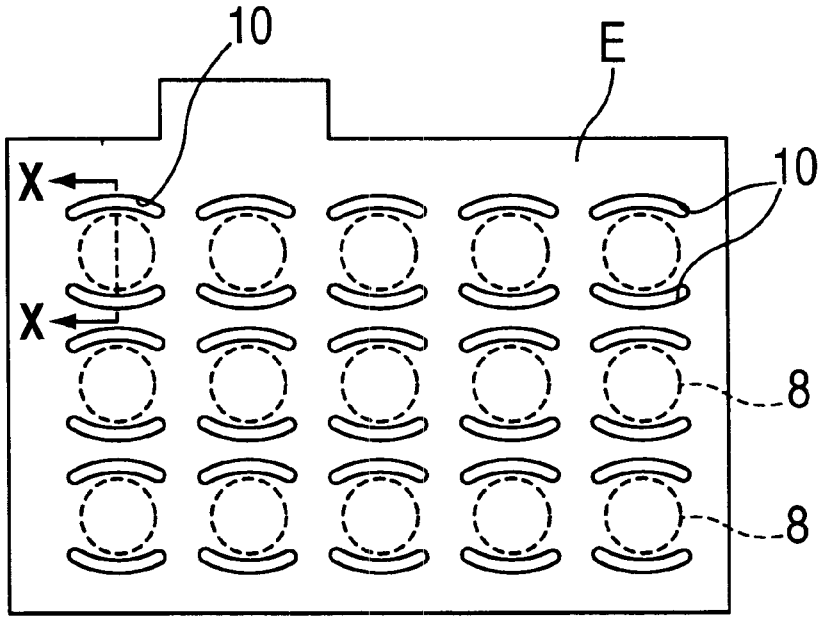
FIG. 1 is a front view showing an embodiment of the invention.
Figure 2:
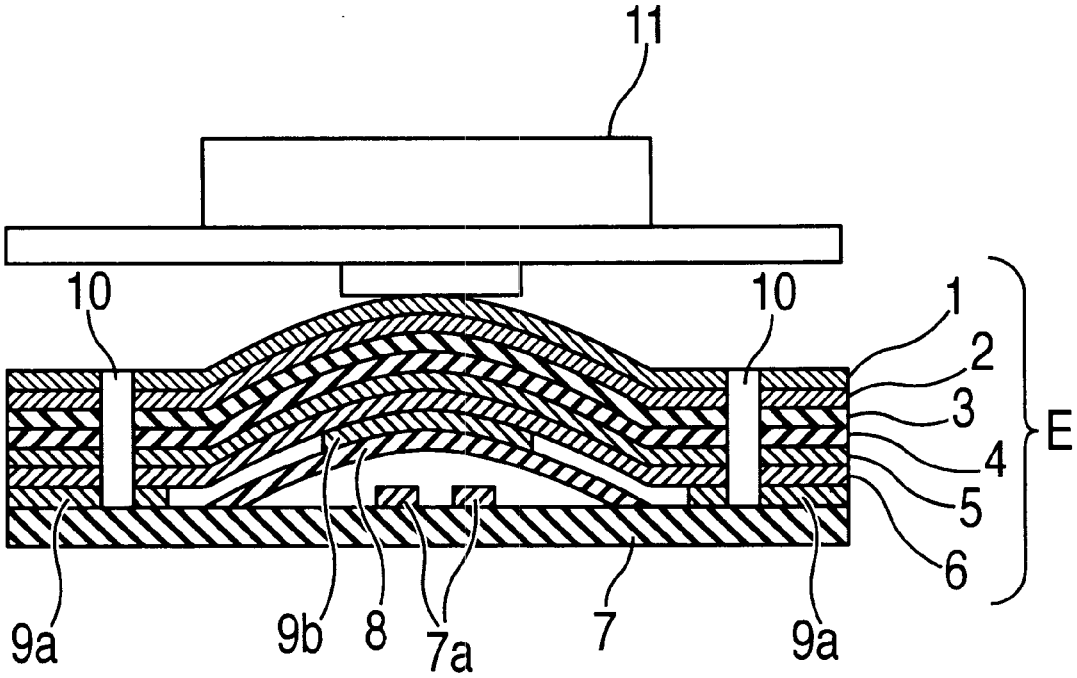
FIG. 2 is an enlarged sectional view taken along a line X—X of FIG. 1.

As shown by FIG. 1 and FIG. 2, an EL sheet E used in the invention is constricted by successively laminating a transparent conductive film 2, a light emitting layer 3, an insulating layer 4 and a back face electrode layer 5 on a transparent board 1. The transparent board 1 is a film made of polyethylene terephthalate (PET) and is vapor-deposited with indium-tin oxide (ITO) constituting the transparent conductive film 2 hereon. In this example, the thickness is 75 $\mu$m.

The light emitting layer 3 is formed by printing a light emitting ink on an upper face of the transparent conductive film 2. The light emitting ink is prepared by mixing and stirring a fluorescent substance constituting zinc sulphide (ZnS) doped with Cu and fluororesin binder. The fluororesin binder is created by dissolving a copolymer of vinylidene fluride and propylene hexafluoride as a binder to methylethylketon as a solvent. The contents are mixed. The light emitting ink is printed on the upper face of the transparent conductive film 2 by a screen printing method, and heated and dried to form the light emitting layer 3.

The insulating layer 4 is formed on an upper face of the light emitting layer 3. Ink for forming the insulating layer 4 is prepared by mixing and stirring a highly dielectric substance comprising barium titanate ($BaTiO_3$) and the above-described fluororesin binder. By using the ink, the insulating layer 4 is formed by a method similar to that in forming the above-described light emitting layer 3.

The back face electrode layer 5 is formed by printing, heating and drying carbon ink on an upper face of the insulating layer 4. Carbon ink is formed by mixing carbon powder, a conductive member, with polyester resin, a binder. Further, the back face electrode layer 5 may be constituted by carbon powder, silver powder and copper powder and polyester (a binder).

The flexible EL sheet is formed in this way. The EL sheet is set to illuminate light by taking timings. For example, when the light illuminating type switch of the invention is adopted in a portable telephone, the EL sheet is set to illuminate light when an arbitrary switch is ON, or, in the case of a structure having an opening and closing type mechanism, the EL sheet is set to illuminate light when opening operation is carried out.

Further, an insulating member 6 is formed on an upper face of the back face electrode layer 5 of the EL sheet E. An electrically insulating material such as polyester, polyvinyl chloride, or polyamide is used for the insulating member 6 to achieve electric insulation from a movable contact, mentioned later.

Further, the above-described transparent conductive film 2 formed on the transparent board 1, is not limited to vapor-depositing ITO on PET but may be a conductive polymer. Polythiophene species conductive polymer is preferable as the conductive polymer. Polyethylene dioxithiophene is preferable as the polythiophene species conductive polymer. In this case, the transparent conductive film 2 can be formed by coating polyethylene dioxithiophene/polystyrene sulfonate on the film 1 of PET and allowing it to dry.

A pair of fixed contacts 7*a* is provided on a base sheet 7. On an upper side of the fixed contacts 7*a*, a dome shaped movable contact 8 is arranged. The dome shaped movable contact 8 is an elastically deformable member using, for example, metal materials having conductivity. The dome shaped movable contact 8 is elastically deformed to recess when depressed to a lower side of the drawing by the finger of a person and recovers to an original shape when the finger removed. The dome shaped movable contact 8 is accompanied by pertinent click feeling when the movable contact is depressed to recess and when the movable contact recovers from an elastically deformed state to the original shape. The movable contact 8 is brought into contact with the pair of fixed contacts 7*a* of the base sheet 7 when depressed to bring about an electrical connection. Therefore, the material of the dome shaped movable contact is not limited to a metal material but may be an elastically deformable conductive material such as rubber mixed with carbon.

The insulating member 6 on the EL sheet E is formed with adhering agents 9*a* and 9*b*. The adhering agent 9*a* is located at a portion opposed to a surrounding area of the movable contact 8. The adhering agent 9*b* is located at a portion opposed to a top face of the dome shaped movable contact 8. The adhering agents are formed by a method of screen printing in a pertinent pattern. The dome shaped movable contact 8 is attached to the EL sheet E and the insulating member 6 by the adhering agent 9*b*. The EL sheet E and the insulating member 6 are dome shaped where they are attached to the dome shaped movable contact 8. The dome shaped movable contact 8 and the fixed contacts 7*a* are positioned opposed to each other. The base sheet 7 is attached to the EL sheet E and the insulating member 6 by the adhering agent 9*a*.

Figure 3:
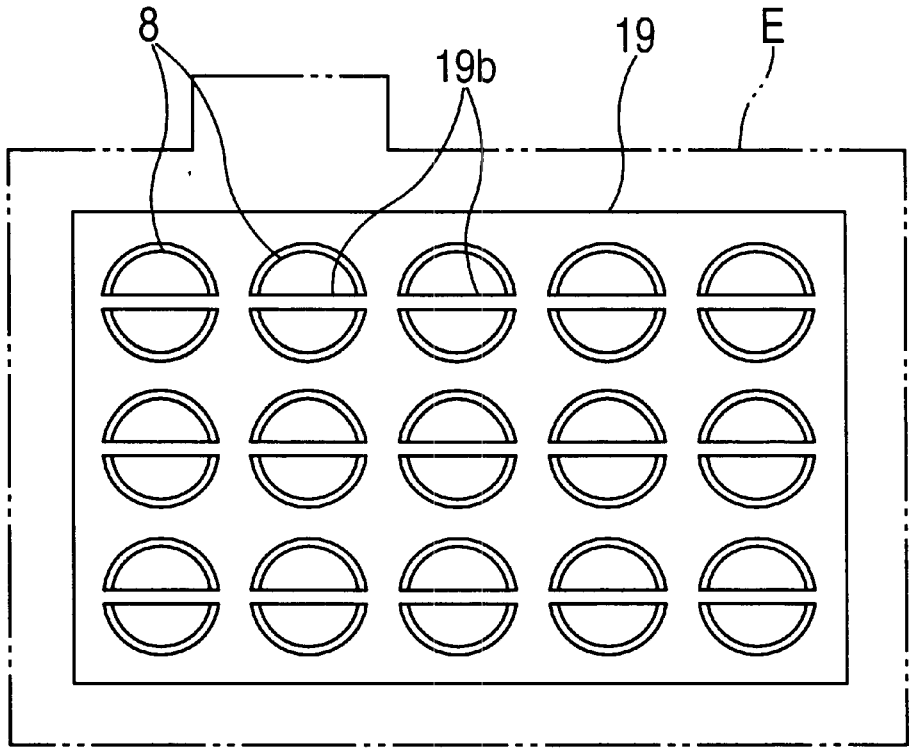
FIG. 3 is a plane view showing a mode of an adhesive double-coated sheet.

Further, an adhesive double-coated sheet may be used in place of the adhering agents 9*a* and 9*b*. The adhesive double-coated sheet may be provided similar to the above-described adhering agents 9*a* and 9*b*. When using the adhesive double-coated sheet in order to improve the connection of the dome shaped movable contact 8 and the EL sheet E to the base sheet 7, one sheet of double adhering member sheet 19 is formed to provide a bridge portion 19*b* passing through a top portion of the respective dome shaped movable contact 8 as shown in FIG. 3. The bridge portion 19*b* provides a pair of semicircles for the respective dome shaped movable contact 8 at a portion of the adhesive double-coated sheet 19 having a desired area at which the movable contact 8 is disposed. The diameter of the movable contact 8 is about 4 through 6 mm and the width of the bridge portion 19*b* of the adhesive double-coated sheet 19 is preferably set to about 0.5 through 2 mm.

The EL sheet E and the insulating member 6 are partially formed with cut portions 10 at positions along an outer peripheral edge of the dome shaped movable contact 8. As shown by FIG. 1, it is preferable that at least a pair of the cut portions 10 are formed at symmetrical positions centering on the dome shaped movable contact 8, or three pieces or more of the cut portions may be formed at uniform intervals. In this case, the cut portions 10 are formed by selecting positions where the transparent electrode layer 2 and the back face electrode layer 5 constituting the EL sheet E are not cut.

The cut portions 10 may be formed before attaching the dome shaped movable contact 8 by using the adhering agents or the adhesive double-coated sheet, or after attaching the base sheet 7. When the cut portions are formed after attaching the base sheet 7, sufficient caution is naturally required such that wirings on the base sheet 7 are not cut. In this way, the light illuminating type switch is formed.

Above the EL sheet, a key operating pad 11 is arranged for making the dome shaped movable contact 8 an ON/OFF switch. The key operating pad 11 is formed by a material of substantially transparent silicone rubber or the like. In the case of a light illuminating type switch by an LED light source, it is necessary to thicken the EL sheet E to some degree in order to achieve uniformity of light illumination of the switch which hampers the thinned formation of the switch. However, in the case of the EL light source as in the case of the invention, the uniformity of light illumination of the switch is achieved by conversely reducing the thickness of the EL sheet E, which is convenient for the thinned formation of the switch. Further, the key operating pad 11 is not indispensable for the switch. The dome shaped movable contact 8 may be operated by directly depressing the surface of the EL sheet E.

In operating the light illuminating type switch, the dome shape is deformed by applying load on an apex portion of the dome shaped movable contact 8. The pair of fixed contacts 7*a* are short-circuited to thereby close the switch. By releasing the load, the dome shaped movable contact 8 is elastically recovered and the pair of fixed contacts 7*a* are not short-circuited and the switch is opened. In deforming the dome shape, click feeling is improved by providing the cut portions 10.

As described above, the cut portions 10 are partially provided at positions along the outer peripheral edge of the dome shaped movable contact 8 in the EL sheet E and the insulating member 6. As compared to the case in which the cut portions 10 are not provided, the invention employing cut portions reduces the degree of constraint on deformation of the dome shaped movable contact 8 by the EL sheet E when the switch is operated. Due to the cut portions, the dome shaped movable contact 8 is operated without being constrained by the EL sheet E to realize the desired click feeling.

Hence, an explanation will be given of results of quantitatively measuring a difference in the click feeling.

Generally, the click feeling of a dome type switch of this kind is represented by a value shown below.

$$\text{Click rate } (\%) = (OF\text{: Operational Force} - RF\text{: Recovery Force}) / (OF\text{: Operational Force}) \times 100$$

Figure 4:
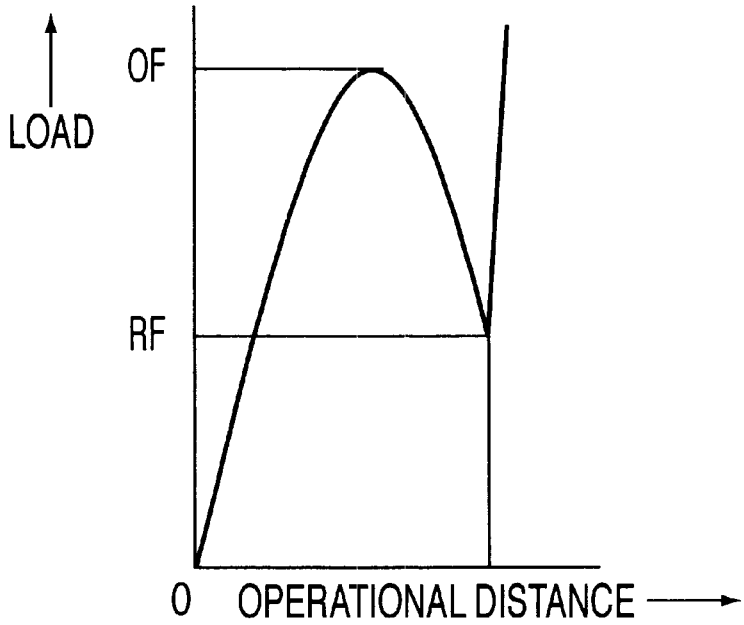
FIG. 4 is a graph for calculating a click rate of a light illuminating type switch.
Figure 5:
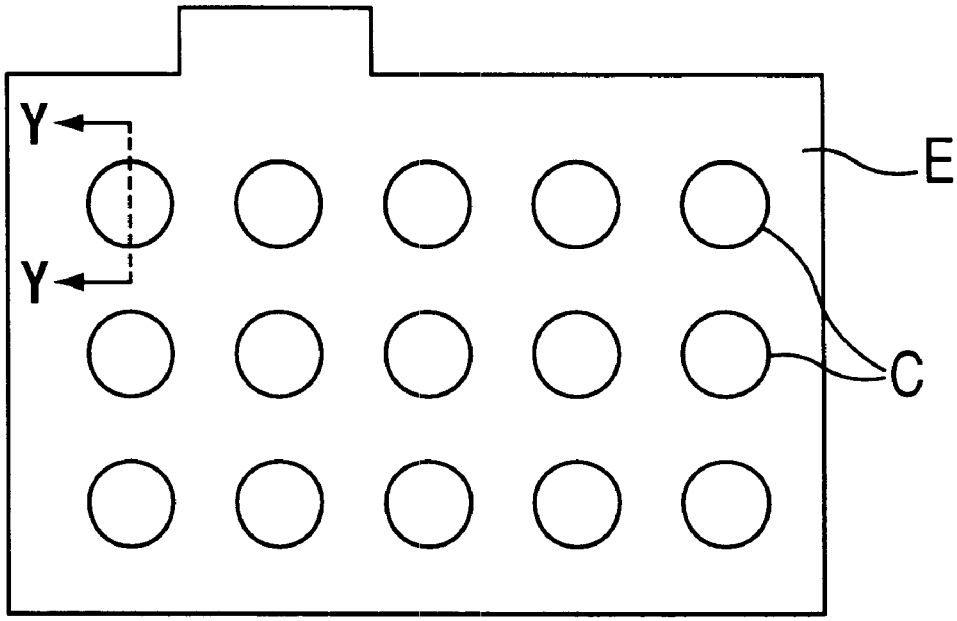
FIG. 5 is a front view showing a prior switch having an EL sheet.
Figure 6:
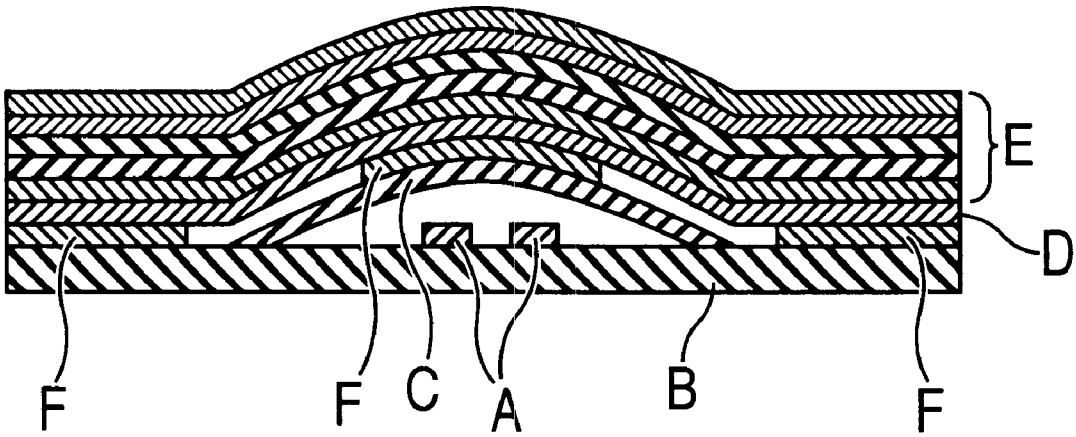
FIG. 6 is an enlarged sectional view taken along a line Y—Y of FIG. 5.

Here, 'OF: Operational Force' indicates a maximum value of load necessary for deforming the dome shape switch from the dome shape to a shape by which the pair of fixed contacts of the base sheet disposed on the lower side are electrically connected (pushed in state) and 'RF: Recovery Force' indicates a value of load at a time where the dome shape switch reaches the shape by which the pair of fixed contacts of the base sheet are electrically connected by the dome shaped switch. The desired click rate is reached when the result of the calculation is 50±10(%). FIG. 4 is a graph calculating the click rate in the light illuminating type switch according to the invention. The ordinate designates load and the abscissa designates operational distance. A large force OF is needed during a time period after starting to depress the apex portion. However, when the apex portion is recessed to some degree, the necessary load is gradually reduced and a small RF is sufficient to close the fixed contacts 7*a*. The invention's click rate of the light illuminating type switch has been 46%. A single dome shaped member switch's click rate is 49% and the prior structure's click rate is 43% as stated above. According to the invention, a click rate of 46% is achieved due to the cut portions 10. The light illuminating type switch has a good click characteristic more proximate to that of the single member of the metal dome.

The light illuminating type switch according to the invention is provided with the cut portions partially at positions along the outer peripheral edge of the dome shaped movable contact. Although light is illuminated by the EL sheet, the light illuminating type switch can achieve the desired click characteristic with a high click rate and have a desired feeling of use.

We claim:

1. A light illuminating type switch comprising:

a) base sheet having a fixed contact;

b) a dome shaped movable contact which when elastically deformed may come in contact with said fixed contact;

c) a flexible EL sheet attached to said dome shaped movable contact; and d) means for reducing the degree of constraint on deformation of the dome shaped movable contact by the flexible EL sheet; said means comprising a cut portion of the flexible EL sheet located along the outer edge of the dome shaped movable contact.

2. A light illuminating type switch as recited in claim 1, wherein at least one pair of said cut portions is located at a symmetrical position centering on the dome shaped movable contact.

3. A light illuminating type switch as recited in claim 1, further comprising a flexible insulating member placed over the domed shape movable contact, and said EL sheet is positioned on said insulating member; wherein the dome shaped movable contact and the flexible insulating member are attached to each other by an adhering agent.

4. A light illuminating type switch as recited in claim 1, further comprising a flexible insulating member placed over the domed shape movable contact, and said EL sheet is positioned on said insulating member; wherein the dome shaped movable contact and the flexible insulating member are attached to each other by an adhesive double coated sheet.

* * * * *